United States Patent [19]

Kawai et al.

[11] Patent Number: 4,674,551

[45] Date of Patent: Jun. 23, 1987

[54] COOLING DEVICE FOR THE TUBE MEMBER USED IN A FORCIBLY COOLED CASTING METHOD AND A METHOD FOR ITS ASSEMBLY

[75] Inventors: Hiroshi Kawai; Yukio Ohtsuka; Kuniaki Mizuno, all of Toyota, Japan

[73] Assignee: Toyota Jidosha Kabushiki Kaisha, Toyota, Japan

[21] Appl. No.: 814,929

[22] Filed: Dec. 30, 1985

[51] Int. Cl.[4] ..... B22D 27/04

[52] U.S. Cl. ..... 164/4.1; 164/137; 164/150; 164/339; 164/342; 164/348

[58] Field of Search ..... 164/137, 348, 126, 128, 164/4.1, 458, 150, 339, 342

[56] References Cited

U.S. PATENT DOCUMENTS

| | | | |
|---|---|---|---|
| 2,110,360 | 3/1938 | Fisher | 164/348 X |
| 3,590,904 | 7/1971 | Woodburn, Jr. | 164/348 X |
| 4,585,047 | 4/1986 | Kawai et al. | 164/348 X |

*Primary Examiner*—Nicholas P. Godici

*Assistant Examiner*—J. Reed Batten, Jr.

*Attorney, Agent, or Firm*—Oblon, Fisher, Spivak, McClelland & Maier

[57] ABSTRACT

In a forcibly cooled casting apparatus including a lower surface plate and an upper cooling plate covering the lower surface plate with a casting mold therebetween, a plurality of tube members extend through the casting mold and having a lower end supported on a receiving base of the surface plate and an upper end received in a positioning hole of the cooling plate. A sleeve provided on the cooling plate supports a protection case within which extends a cooling nozzle which passes through the cooling plate. The cooling nozzle is connected to a source of cooling fluid and has a tapered tip which fits in the upper end of the tube member so that cooling fluid can flow through the tube member. A spring compressed within the protection case biases the cooling nozzle into fluid tight contact with the tube member. A detector is provided for detecting improper positioning of the cooling nozzle.

12 Claims, 11 Drawing Figures

COOLING DEVICE FOR THE TUBE MEMBER USED IN A FORCIBLY COOLED CASTING METHOD AND A METHOD FOR ITS ASSEMBLY

BACKGROUND OF THE INVENTION

1. Field of the Invention

The invention relates to a cooling device which has a cooling nozzle for introducing a coolant through the tube member used in a forcibly cooled casting and which is cast as part of the casting, said cooling nozzle being fit to the tube member accurately and tightly, and a method for its assembly.

In general, for the production of an aluminum alloy casting such as an aluminum cylinder head that is free of casting defects, it is desirable that the poured metal solidifies rapidly and that the solidification be unidirectional. In gravity casting and low pressure casting in the prior art, metallic molds have been water-cooled or air-cooled to promote fast metal solidification. For this type of mold cooling it is required to control the metallic mold temperature relatively rigorously in order to avoid over-cooling in the mold which may cause the metal poured in the mold cavity to be insufficiently fluid. Such control requires relatively sophisticated technology because of the periodic variations in the mold temperature as the casting cycle proceeds. Further, the cooling device provided in the metallic mold makes mold construction more complicated, giving rise to a higher metallic mold cost.

For the desired unidirectional solidification of the metal poured in the mold, the position and the shape of the riser, its volume, etc. are selected empirically, but such selection is limited by the shape of the casting in the mold. It is therefore sometimes impossible to achieve unidirectional solidification by the riser alone. In addition, in the prior art the speed of solidification of the poured metal in the mold is not fast enough in general and castings produced are not strong enough.

2. Description of the Related Art

Due to the above mentioned disadvantages, the Applicant has proposed a forcibly cooled casting method in which a tube member is placed in the cavity of a mold and the molten metal poured in the cavity incorporates therein the tube portions in contact with the hot metal. The poured metal is then cooled by passing a coolant through the tube so that the metal solidifies faster. This forcibly cooled casting method therefore uses the tube member which will be incorporated into a completed casting in order to cool the poured metal. In this method it may be possible to bring about unidirectional solidification in the metal near the outer face of the tube with the excellent advantage of improved strength in the casting accompanied by a shortened casting cycle time.

It is necessary, however, in the above mentioned forcibly cooled casting method, to position said tube member in either a sand mold or a metallic mold before casting, and when the tube member is exactly positioned in the mold at a specified position, connecting to the tube member a nozzle for injecting a coolant into the tube member, but the above method provides no specific method for such steps.

SUMMARY OF THE INVENTION

An object of the invention is to provide a cooling device that correctly positions and fits the tube member to be placed in the mold and incorporated in the casting and which supports exactly and tightly the connecting nozzle used for supplying the coolant, and a method for its assembly.

In a forcibly cooled casting arrangement the tube member enters the cavity of a mold placed on a surface plate and the lower end of the tube member is supported in a receiving base provided in the surface plate. A cooling plate which has a positioning hole to position the upper opening of the tube member so positions the tube member by descending from above onto the tube member and cools the mold after pouring metal into the cavity. A connecting structure is provided on the cooling plate for connecting a conduit to supply a coolant to the upper end of the tube member.

The connecting device includes a support member consisting of a sleeve provided on the cooling plate and a hollow case mounted on the upper section of said sleeve. A cylindrical cooling nozzle extends through the support member and is freely vertically movable. The cooling nozzle is provided with an end portion of a diameter small enough to fit into the upper end of the tube member and a main body of a larger diameter held positioned above the tube member by a stepped portion. A coolant conduit for supplying a coolant is connected to the cooling nozzle and a spring member is provided between a guard formed approximately at the middle point of the cooling nozzle and the top plate of the hollow case, the spring biasing the cooling nozzle downward.

As the cooling plate descends, it positions the upper end of the tube member by means of its positioning hole and the tip portion of said cooling nozzle fits into the upper end opening of the tube member, at which time the force of the spring member urges a tighter connection between the cooling nozzle and the tube member. The cooling nozzle has a tapered end with a smaller diameter at its end, and when this tapered end is urged by the spring member it guides the fitting of the nozzle to the end opening of the hollow tube member.

Further, the outer circumference of the exposed end of the cooling nozzle is provided with a position detection means which includes a cylindrical body with an annular groove. A sensing rod has a tip section which is located in the annular groove of the cylindrical body. It is, therefore, possible to detect by the position detection means incomplete insertion of the cooling nozzle into the top of the hollow tube member by the relative positions of the rod top and the annular groove. Mispositioning can be made known to the operator by providing the position detection device with an alarm device.

With the above arrangement, after a mold is placed on a surface plate, the tube member is inserted into the holes provided therefor on the mold and the surface plate, and the lower opening end of the tube member is received in a receiving base on the surface plate, and so is positioned correctly. Next, the cooling plate is lowered from above and its positioning hole fits on the upper end of the tube member. As a result, the upper section of the cooling nozzle which is supported on a support member provided above the positioning hole, and the upper end of the hollow tube member, gradually mate. The tube member and the cooling nozzle mate together with the small diameter nozzle end section entering the hollow tube member and the upper end of the tube member engaging the stepped section of the nozzle.

The cooling nozzle then stops descending, but the cooling plate descends further to a certain extent. As a result the spring member is compressed between the top plate of the hollow case on the support member and a portion of the cooling nozzle, which urges the cooling nozzle downwards, making the upper end opening of the tube member and the stepped section connect tightly. This state is maintained so that the connection between the cooling nozzle and the tube member remains tight, and the coolant led to the cooling nozzle is supplied to the tube member without leaking out of its upper end. The coolant supplied to the tube member flows downwards, cooling the hot metal while it passes through the hollow tube member, flows out of the lower end of the tube member and impinges on the inclined upper face of the receiving base, and flows sideways towards the lower face of the surface plate.

By means of the cooling device according to the invention used in the forcibly cooled casting method for tight fitting of the tube member and the cooling nozzle, the task of matching the cooling plate to the surface plate with tightness in the fitting of the tube member to the nozzle of the conduit to supply a coolant is achieved. Furthermore, the tight connection prevents leakage of the coolant, and the resulting cooling of the metal poured into the mold promotes unidirectional solidification of the casting with improved efficiency of cooling.

If the tube member and the cooling nozzle fail to connect properly, this can be detected at once by the automatic position detection device, so that no visual check is necessary. Misconnection can also be made known to the operator by providing the position detection device with an alarm device.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Next, an embodiment of the present invention will be described in reference to the drawings.

Figure 2:
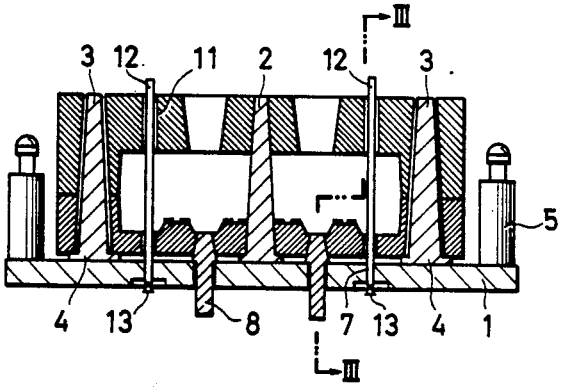
FIG. 2 is a cross-sectional view of a sand mold without a frame used for an embodiment of the invention, showing the structure used to match mold halves.
Figure 4:
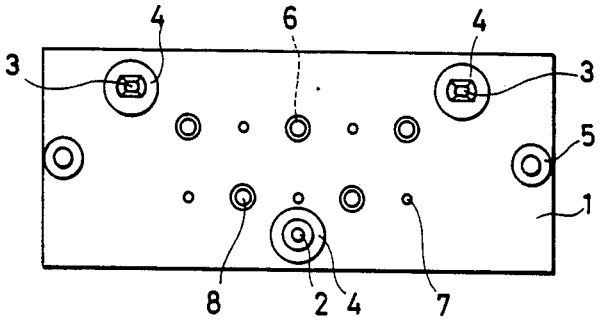
FIG. 4 is a plan view of the surface plate of FIG. 2.

In FIG. 2, 1 is a rectangular flat surface plate main body. Three positioning pins 2, 3 and 3 are erected and fixed on the surface plate 1. The three positioning pins 2, 3 and 3, as shown in FIG. 4, occupy the positions of the apexes of an equilateral triangle. The positioning pin 2 positioned at the apex where two equilateral sides intersect is a round pin with a circular cross section, and the other pins are rectangular pins 3, 3 with a rectangular cross section. The lower section of each pin 2, 3 or 3 is provided with a base plate 4 to level the casting mold. The round pin and the rectangular pins are tapered respectively to form a cone and prisms.

Mounted to the body 1 near each longitudinal end thereof is a guide pin 5. Further, the surface plate main body 1 is provided with holes for mounting chillers and tube members which are used for forcibly cooling the molten metal poured into the mold. FIG. 4 shows five holes 6 for chillers and five holes 7 for tube members.

In FIG. 2 chillers 8 have been inserted into the chiller hole 6.

Onto the positioning pins 2, 3 and 3 of the surface plate main body is placed a sand mold 9. The positioning pins act for positioning and mold matching of the mold. The sand mold 9 has a cope 9*a* and a drag 9*b*. The cope 9*a* and the drag 9*b* are provided with pin holes 10 corresponding to the positions of the positioning pins 2, 3 and 3. The positioning pin hole 10 that corresponds to the round pin 2 is substantially of the same size as the round pin 2, and the holes that correspond to the rectangular pins 3 have a substantially rectangular cross section and the same depth as the rectangular pins 3, but a longer width than the rectangular pin 3 (where the depth is defined as being the shorter of the sectional dimensions of the rectangular pins and pin holes). The sand mold 9 is also provided with a hole 11 through which the tube member 12 passes. The tube member 12 is supported by a receiving base 13 mounted on the lower surface plate main body 1. The cross section of the receiving base 13 is triangular and its apex ridge contacts the tube member 12.

At the position opposite to the surface plate 1, a cooling plate 14 is provided, which is driven by a driving means (not shown) so as to move toward (descending) or away from (ascending) the surface plate main body 1. The cooling plate 14 is provided with guide bushes 15 at positions corresponding to the guide pins 5. At the position that corresponds to the hole 11 of the sand mold 9, the cooling plate is provided with a hole 17 for passing the tube member 12. At the position on the upper side of the cooling plate main body 14 that corresponds to the hole 17, a sleeve 18 for a cooling nozzle is mounted, and the upper section of this sleeve 18 is provided with a protection case 19 for supporting and guiding a spring or springs and the upper section of the cooling nozzle main body. The sleeve 18 and protection case 19 form a support means for the cooling nozzle.

The cooling nozzle 16 is inserted into the sleeve 18 and is freely movable therein. The cooling nozzle 16 is connected to a conduit 20 through which a coolant flows. Near the center of the cooling nozzle main body 16*b* a guard section 16*a* is formed. A compression spring 21 is placed between this guard section 16*a* and the top plate of the protection case 19. The tip 16*c* of the cooling nozzle 16 is cone-shaped and the diameter of the main body 16*b* of the cooling nozzle 16 is about the same as the diameter of the tube member 12. Consequently, when the tip section 16*c* of the cooling nozzle 16 is inserted into the tube member 12, the tip section 16*c* fits completely in the tube member 12 and the cooling nozzle main body 16*b* abuts it at a stepped portion connecting the tip section and main body of the cooling nozzle.

Figure 9:
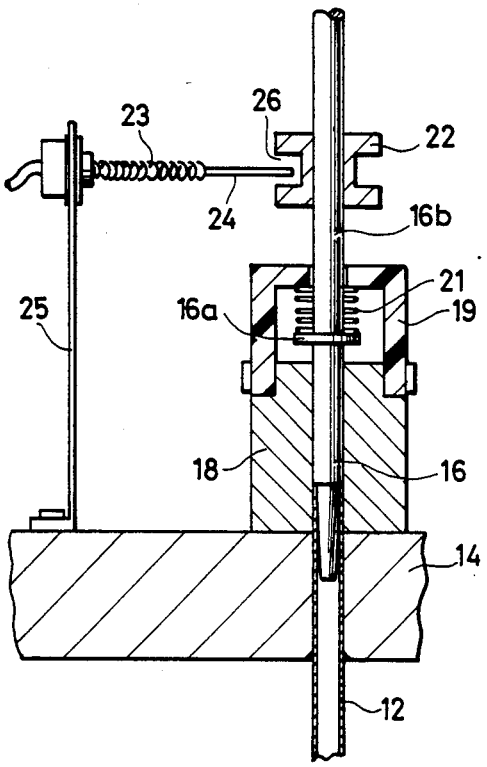
FIG. 9, FIG. 10 and FIG. 11 are cross-sectional views of detection means for detecting an abnormality in the insertion of the cooling nozzle according to the invention, FIG. 9 showing the normal insertion and FIG. 10 and FIG. 11 showing abnormal insertions.

Further, on the upper side of the cooling plate main body 14 and near the spring 21, a detection device is provided which detects an abnormality in the insertion of the cooling nozzle 16 into the tube member 12. This detection device, as shown in FIG. 9, comprises a cylindrical body 22 which is mounted on the outer circumference of the nozzle main body above the protection case 19, an aerial rod 24 held by a spring 23, and a bracket 25 mounted on the cooling plate main body 14 which holds a detecting element to which the spring 23 is attached with the aerial rod 24 maintained at a specified location. The cylindrical body 22 constitutes an object to be detected and has an annular groove 26 nearly at its axial center. The end of the aerial rod 24 is normally inserted into the groove 26.

When the aerial rod contacts either the upper wall face or the lower wall face of the annular groove 26 (refer to FIG. 10 and FIG. 11), an abnormality in the insertion is detected. When the aerial rod 24 is not in contact with either of the wall faces (refer to FIG. 9) no abnormality is detected. The contact between aerial rod 24 and the wall face of the groove 26 is sensed by the detecting element (for example, by such contact completing an electric circuit) and the detecting element responds by transmitting an electrical signal to a buzzer or an alarm lamp to be displayed or otherwise conveyed. When an abnormality is detected, an automatic stopping mechanism may be automatically activated.

The assembly of a sand mold used in the forcibly cooled casting method will be explained below.

Figure 5:
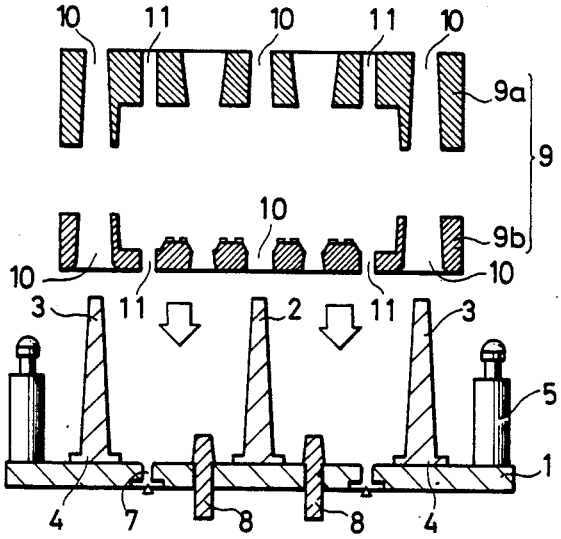
FIG. 5 is similar to FIG. 2, but shows the method of mounting the mold on the surface plate.
Figure 6:
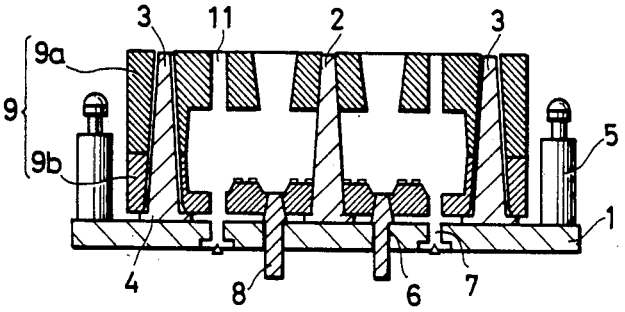
FIG. 6 shows the mounting of the mold on the surface plate of FIG. 2.

First, a surface plate main body 1 is prepared as shown in FIG. 4, and is set almost horizontally with the positioning pins 2, 3 and 3 facing upwards. Next chillers 8 are passed through chiller holes 6 with their top being adjacent the positioning pins 2, 3 and 3. After the positioning pins 2, 3 and 3 of the surface plate main body 1 and the positioning pin hole 10 of the drag 9*b* are matched as shown in FIG. 5, the drag 9*b* is lowered gradually onto the positioning pins 2, 3, and 3. Then the drag 9*b* is pushed down until it abuts the base plates 4 for leveling the drag 9*b*. Next, the cope 9*a* is passed onto the positioning pins 2, 3 and 3 to be matched to the drag 9*b*. As shown in FIG. 6, the cope 9*a* and drag 9*b* are guided to their positions by the positioning pins 2, 3 and 3 are both matched accurately.

Figure 3:
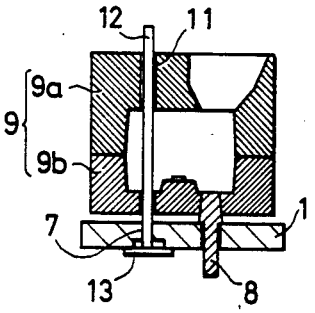
FIG. 3 is the cross-sectional view seen along the line III—III of FIG. 2.

Next, as shown in FIG. 2, tube members 12 are inserted from above through the holes 11 for the tube members and the holes 7 for the tube members, the lower ends of the tube members 12 being made to strike the receiving bases 13 (refer to FIG. 3). As a result, the lower end of the tube members is positioned correctly.

Figure 1:
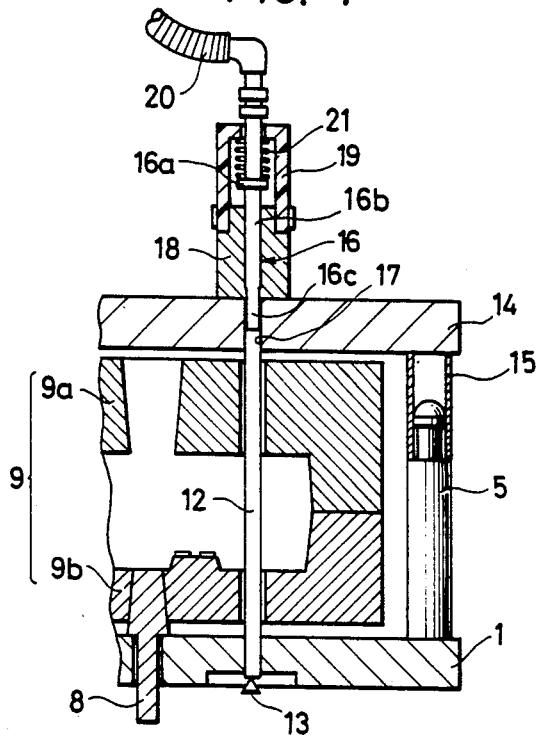
FIG. 1 is a cross-sectional view of a cooling device including an embodiment of the present invention which is used in the forcibly cooled casting method.
Figure 7:
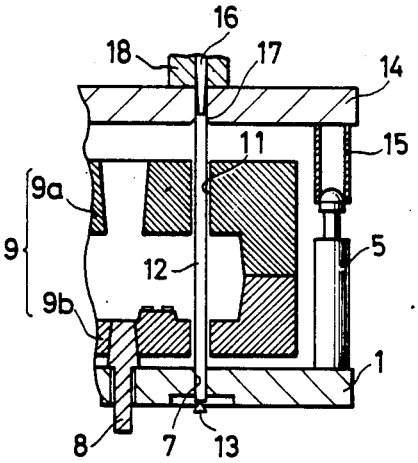
FIGS. 7 and 8 are cross-sectional views of portions of FIG. 2 showing the processes of fitting the cooling plate main body to the surface plate main body.
Figure 8:
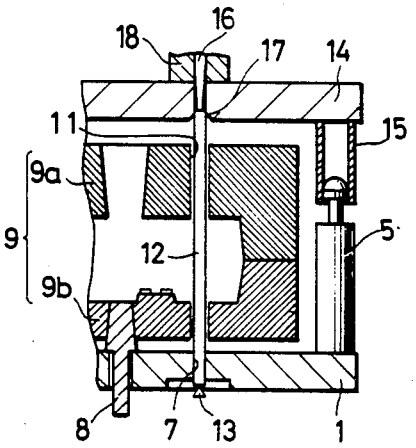

Then when the cooling plate main body 14 is lowered, the guide bushes 15 first fit the guide pins 5 mounted on the surface plate main body 1 as shown in FIG. 7 and FIG. 8 to mutually position the cooling plate main body 14 and the surface plate main body 1. By continued lowering of the cooling plate 14, the tube member 12 is guided into the hole 17 provided in the cooling plate 14 and the upper section of the tube member 12 is thus positioned. After this, the tip of the cooling nozzle 16 which is freely slidable in the sleeve 18 is inserted into the tube member 12. When the cooling nozzle tip 16*c* is pushed in for a certain distance, the cooling nozzle abuts the tube member 12 and is held downward in this position by the compression spring 21. Accordingly, when the surface plate 1 and the cooling plate 14 are properly positioned, the tube member 12 and the cooling nozzle 16 are tightly connected as shown in FIG. 1 by the urging force from the compression spring 21.

Figure 10:
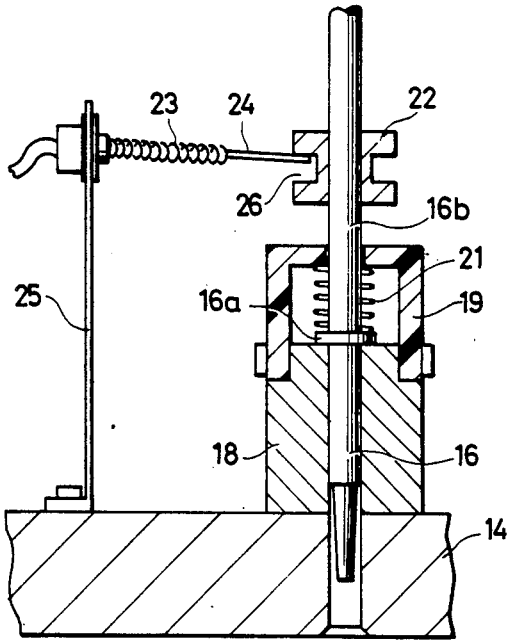
Figure 11:
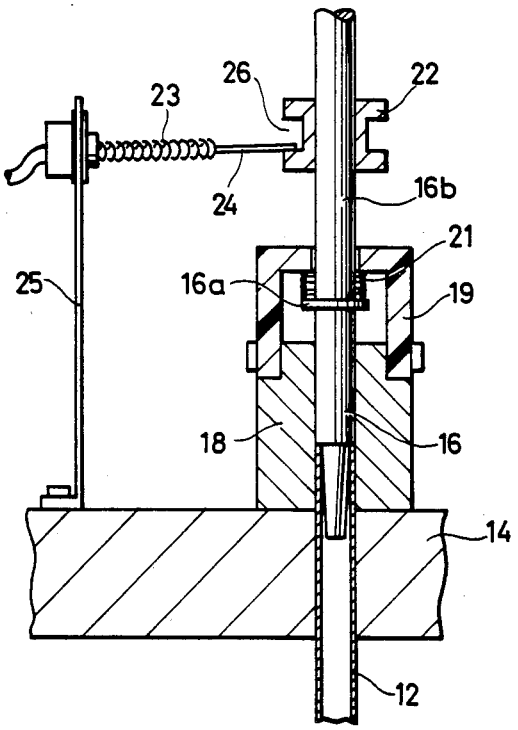

In the final state when the surface plate 1 and the cooling plate 14 are in contact, if the cooling nozzle 16 and the tube member 12 are accurately matched and positioned, the aerial rod 24 is not in contact with the faces of the annular groove 26 of the cylindrical body 22, and so no mispositioning is detected. As shown in FIG. 10 and FIG. 11, if the aerial rod 24 is in contact with the upper face of the annular groove of the cylindrical body 22, the tube member 12 and the cooling nozzle 16 are not in abutment, and if the aerial rod 24 is in contact with the lower face of the annular groove of the cylindrical body 22, the contact of the tube member 112 with the cooling nozzle 16 is not tight enough, suggesting clogging, etc. in the tube member 12 or in some other part. In this case, a buzzer or a lamp (not shown) provides an operator with an abnormality alarm and the automatic stopping mechanism is activated.

By the tight connection of the tube member 12 and the cooling nozzle 16*c* in the forcibly cooled casting device in this embodiment, the simple operation of matching the surface plate main body with the cooling plate 14 automatically brings about exact positioning of the tube member 12 and after this the tube member 12 and the cooling nozzle 16 are fitted rigidly and tightly and held in this state by the lateral pressure exerted on them.

With the provision of the abnormality detection device, it is easily known whether or not the tube member 12 and the cooling nozzle 16 are correctly mated.

The invention is not limited to the above embodiment. It will be understood that various modifications of the embodiment can be included in the scope of the appended claims. For instance, although in the embodiment a sand mold was described, the mold can be metallic.

What is claimed as new and desired to be secured by Letters Patent of the United States is:

1. A method of assembling a forcibly cooled casting apparatus having a surface plate, a cooling plate and a casting mold, said method comprising the steps of:

positioning said casting mold on said surface plate;

fitting at least one tube member through said casting mold until one end of each said tube member is supported on a receiving base of said surface plate;

lowering onto said surface plate and casting mold a cooling plate having at least one cooling nozzle extending therethrough and mounted thereon by means permitting relative vertical movement between said cooling plate and each said cooling nozzle and means biasing each said cooling nozzle downward relative to said cooling plate; and positioning said cooling plate such that another end of each said tube member fits in a positioning hole of said cooling plate with a tip of each said cooling nozzle fitted in one said tube member with said fitted relationship being maintained by said biasing means.

2. The method of claim 1 including the step of providing means for detecting an abnormality in said positioning step.

3. In a forcibly cooled casting apparatus, including a lower surface plate and an upper cooling plate covering said surface plate with a casting mold therebetween, tube member cooling means comprising:

at least one tube member extending through said casting mold, each said tube member having an end supported on a receiving base of said surface plate and another end received in a positioning hole of said cooling plate;

supply tube means for supplying a coolant to each said tube member; and connecting means for connecting said supply tube means to each said tube member, said connecting means comprising (a) at least one cooling nozzle in fluid communication with said supply tube means, said cooling nozzle having a reduced diameter tip portion, (b) means on said cooling plate for supporting each said cooling nozzle for passing through said cooling plate with said tip portion inserted in said other end of one said at least one tube member, and (c) means for biasing said tip portion into said other end with a fluid tight seal between said cooling nozzle and said tube member.

4. The apparatus of claim 3, wherein said tip portion is tapered.

5. The apparatus of claim 3, wherein said means for supporting comprise a sleeve provided on said cooling plate and a protection case mounted on an upper section of said sleeve.

6. The apparatus of claim 5, wherein said means for biasing comprise a spring positioned in said protection case between a guard of said cooling nozzle and a top of said protection case.

7. The apparatus of claim 5, including means for detecting improper insertion of said tip portion in said other end of said tube member.

8. The apparatus of claim 7, wherein said means for detecting comprises:

a cylindrical member fixed to said cooling nozzle at a position above said cooling plate, said cylindrical member having an annular groove;

a rod having a tip positionable in said groove; and means for detecting contact between said rod tip and axial faces of said groove.

9. The apparatus of claim 8 including means for notifying an operator of said detected contact.

10. The apparatus of claim 3, including means for detecting improper insertion of said tip portion in said other end of said tube member.

11. The apparatus of claim 10, wherein said means for detecting comprises:

a cylindrical member fixed to said cooling nozzle at a position above said cooling plate, said cylindrical member having an annular groove;

a rod having a tip positionable in said groove; and means for detecting contact between said rod tip and axial faces of said groove.

12. The apparatus of claim 11 including means for notifying an operator of said detected contact.

* * * * *